US009039502B2

(12) United States Patent
Matsubara

(10) Patent No.: US 9,039,502 B2
(45) Date of Patent: May 26, 2015

(54) AIR CONDITIONER

(75) Inventor: Atsushi Matsubara, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 377 days.

(21) Appl. No.: 13/130,261

(22) PCT Filed: Oct. 22, 2009

(86) PCT No.: PCT/JP2009/068160
§ 371 (c)(1),
(2), (4) Date: May 19, 2011

(87) PCT Pub. No.: WO2010/058676
PCT Pub. Date: May 27, 2010

(65) Prior Publication Data

US 2011/0230132 A1 Sep. 22, 2011

(30) Foreign Application Priority Data

Nov. 20, 2008 (JP) ..... 2008-296874

(51) Int. Cl.
*F24F 11/00* (2006.01)
*F24F 1/00* (2011.01)

(52) U.S. Cl.
CPC ..... *F24F 11/0078* (2013.01); *F24F 1/0007* (2013.01); *F24F 2001/0048* (2013.01)

(58) Field of Classification Search
USPC ..... 454/229, 256, 333
See application file for complete search history.

(56) References Cited

U.S. PATENT DOCUMENTS 5,039,008 A * 8/1991 Sugawara et al. ..... 236/49.3
5,072,878 A * 12/1991 Aoki et al. ..... 236/38
5,097,672 A * 3/1992 Takenaka et al. ..... 62/186
5,180,333 A * 1/1993 Shyu ..... 454/319
5,331,825 A * 7/1994 Kim ..... 62/180
5,660,588 A * 8/1997 Kotoh et al. ..... 454/285
5,720,176 A * 2/1998 Manson et al. ..... 62/89
5,810,661 A * 9/1998 Bang ..... 454/286
5,857,343 A * 1/1999 Cho et al. ..... 62/89
5,875,639 A * 3/1999 Kim et al. ..... 62/186
5,899,807 A * 5/1999 Kim et al. ..... 454/229
8,364,317 B2 * 1/2013 Park et al. ..... 700/276
8,392,026 B2 * 3/2013 Matsumoto et al. ..... 700/276
2004/0237572 A1 * 12/2004 Lee et al. ..... 62/419
2004/0244391 A1 * 12/2004 Kouno et al. ..... 62/176.1
2006/0286923 A1 * 12/2006 Oka et al. ..... 454/259
2008/0100246 A1 * 5/2008 Kim et al. ..... 318/443
2008/0254734 A1 * 10/2008 Uenaka et al. ..... 454/256
2012/0214399 A1 * 8/2012 Tsuji ..... 454/333
2012/0220212 A1 * 8/2012 Tsuji ..... 454/333

FOREIGN PATENT DOCUMENTS

EP 1 548 375 A1 6/2005
JP 63-217161 A 9/1988

(Continued)

*Primary Examiner* — Steven B McAllister
*Assistant Examiner* — Jonathan Cotov
(74) *Attorney, Agent, or Firm* — Birch, Stewart, Kolasch & Birch, LLP

(57) ABSTRACT

In the air conditioner, determination is made whether or not a "3-Dimensional Swing" or a "Left/Right Swing" relating to movement of a left/right flap is set (step S2). When it is determined that the "3-Dimensional Swing" or "Left/Right Swing" is set (step S2: Yes), a determination is made whether or not the swing range of the left/right flap is set to a part of the movable range (step S3). When it is determined in step S3 that the swing range of the left/right flap is set (step S3: Yes), the left/right flap is once returned to the reference position (step S4), and then reciprocation of the left/right flap within the swing range is started (step S5).

17 Claims, 15 Drawing Sheets

(56) References Cited

FOREIGN PATENT DOCUMENTS

| | | | | |
|---|---|---|---|---|
| JP | 2-61452 | A | | 3/1990 |
| JP | 2061452 | | * | 3/1990 |
| JP | 2-287041 | A | | 11/1990 |
| JP | 4-62349 | A | | 2/1992 |
| JP | 5-264091 | A | | 10/1993 |
| JP | 6-50588 | A | | 2/1994 |
| JP | 6050588 | | * | 2/1994 |
| JP | 2000-199639 | A | | 7/2000 |

* cited by examiner

AIR CONDITIONER

TECHNICAL FIELD

The present invention relates to an air conditioner having a wind direction changing flap for changing, to the left or right, the direction of the wind from an outlet port of an indoor unit.

BACKGROUND ART

In recent years, there has been developed an air conditioner in which a left/right range of the wind direction from an outlet port is settable to a desirable range, according to the installation position of the indoor unit (e.g. Patent Documents 1 and 2). The Patent Documents 1 and 2 disclose a technology for automatically setting a movable range of a wind direction changing flap according to the installation position selected by using a remote controller or the like.

PRIOR ART DOCUMENT

Patent Document

[Patent Document 1] Japanese Unexamined Patent Publication No. 62349/1992 (Tokukaihei 4-62349)
[Patent Document 2] Japanese Unexamined Patent Publication No. 50588/1994 (Tokukaihei 6-50588)

DISCLOSURE OF THE INVENTION

Problems to be Solved by the Invention

For example, when the indoor unit of the Patent Documents 1 and 2 is installed on the left side of the room, the swing range of the wind direction changing flap 116 is set to the right side as shown in FIG. 18 (shaded area in FIG. 18(*a*)). However, when the wind direction changing flap 116 is moved by mishandling as shown in FIG. 18(*b*); e.g., when the wind direction changing flap is moved by a hand of the user, the wind direction changing flap 116 moves within a range (shaded area in FIG. 18(*b*)) which is displaced from the swing range (shaded area) shown in FIG. 18(*a*) within which the wind direction changing flap 116 is intended to be moved.

The present invention is made in view of the above problem, and it is an object of the present invention to provide an air conditioner in which a wind direction changing flap is prevented from moving outside a set swing range.

Means to Solve the Problems

A first aspect of the present invention is an air conditioner, including a wind direction changing flap which changes, to the left or right, the direction of the wind from an outlet port of an indoor unit; and a controller which controls a movement of the wind direction changing flap, wherein the controller returns the wind direction changing flap to a reference position when the wind direction changing flap is to be moved within a swing range set at a part of a movable range in which the wind direction changing flap is able to move.

In the air conditioner, the wind direction changing flap is once returned to the reference position when the swing range of the wind direction changing flap is set. Therefore, the wind direction changing flap is prevented from moving outside the swing range. This enables the wind direction changing flap to move within a proper swing range, even when the wind direction changing flap is moved by mishandling; e.g., moving the wind direction changing flap by a hand of the user.

A second aspect of the present invention is the air conditioner of the first aspect adapted so that the swing range is set based on a distance from the reference position. Note that the expression "set based on the distance from the reference position" encompasses "setting based on the angle with respect to the reference position", "setting based on the number of pulses corresponding to the distance from the reference position, which pulses are supplied to a stepping motor", and "setting based on the duration of movement starting from the reference position".

In this air conditioner, the swing range is set based on the distance from the reference position. Therefore, the wind direction changing flap is easily moved within the swing range set based on the distance from the reference position, by once returning the wind direction changing flap to the reference position.

A third aspect of the present invention is the air conditioner of the first or second aspect, adapted so that the reference position is set at a position corresponding to an end of the movable range.

In this air conditioner, the end of the movable range which is the starting point of the reciprocation of the wind direction changing flap is set as the reference position. The wind direction changing flap is therefore reliably returned to the reference position.

A fourth aspect of the present invention is the air conditioner of any one of the first to third aspects, adapted so that the reference position is set on both side of the swing range.

In the air conditioner, the reference position is provided to the both sides of the swing range. Therefore, the reference position on the side closer to the wind direction changing flap can be set as the reference position. This shortens the time needed to return the wind direction changing flap to the reference position, and the starting point correcting operation for the wind direction changing flap is performed without confusing a user.

A fifth aspect of the present invention is the air conditioner of any one of the first to fourth aspects, adapted so that, at the start of operation of the indoor unit, the controller returns the wind direction changing flap of the indoor unit to the reference position if the swing range is set to a part of the movable range.

In the air conditioner, the wind direction changing flap is returned to the reference position when the operation of the air conditioner is started. This way the starting point correcting operation for the wind direction changing flap is performed without confusing user.

A sixth aspect of the present invention is the air conditioner of any one of the first to fifth aspects, adapted so that the controller returns the wind direction changing flap to the reference position at a time of starting the movement of the wind direction changing flap, when the swing range is set at a part of the movable range.

In the air conditioner, the wind direction changing flap is returned to the reference position when the movement of the wind direction changing flap is started. This way the starting point correcting operation for the wind direction changing flap is performed without confusing a user.

A seventh aspect of the present invention is the air conditioner of any one of the first to sixth aspects, adapted so that the controller returns the wind direction changing flap to the reference position when the swing range is set to a part of the movable range.

In the air conditioner, the wind direction changing flap is returned to the reference position when the swing range of the wind direction changing flap is set. This way the starting point correcting operation for the wind direction changing flap is performed without confusing a user.

An eighth aspect of the present invention is the air conditioner of any one of the fifth to seventh aspects, adapted so that, the controller returns the wind direction changing flap to the reference position when the wind direction changing flap moves towards the reference position.

In the air conditioner, the wind direction changing flap is returned to the reference position while the wind direction changing flap is moving towards the reference position, instead of changing the moving direction of the wind direction changing flap moving away from the reference position. This way the starting point correcting operation for the wind direction changing flap is performed without confusing a user.

A ninth aspect of the present invention is the air conditioner of any one of the first to eighth aspects, adapted so that the swing range of the wind direction changing flap is set based on an installation position of the indoor unit.

In the air conditioner, the wind direction changing flap is moved to the proper swing range set according to the installation position, even if the wind direction changing flap is moved outside the swing range due to a mishandling by the user or the like.

Advantageous Effects

As hereinabove stated, the present invention brings about the following effects.

In the first aspect of the present invention, the wind direction changing flap is once returned to the reference position when the swing range of the wind direction changing flap is set. Therefore, the wind direction changing flap is prevented from moving outside the swing range. This enables the wind direction changing flap to move within a proper swing range, even when the wind direction changing flap is moved by an inappropriate operation such as moving the wind direction changing flap by a hand of the user.

In the second aspect of the present invention, the swing range is set based on the distance from the reference position. Therefore, the wind direction changing flap is easily moved within the swing range set based on the distance from the reference position, by once returning the wind direction changing flap to the reference position.

Further, in the third aspect of the present invention, the end of the movable range which is the starting point of the reciprocation of the wind direction changing flap is set as the reference position. The wind direction changing flap is therefore reliably returned to the reference position.

In the fourth aspect of the present invention, the reference position is provided to the both sides of the swing range. Therefore, the reference position on the side closer to the wind direction changing flap can be set as the reference position. This shortens the time needed to return the wind direction changing flap to the reference position, and the starting point correcting operation for the wind direction changing flap is performed without confusing a user.

In the fifth aspect of the present invention, the wind direction changing flap is returned to the reference position when the operation of the air conditioner is started. This way the starting point correcting operation for the wind direction changing flap is performed without confusing user.

In the sixth aspect of the present invention, the wind direction changing flap is returned to the reference position when the movement of the wind direction changing flap is started. This way the starting point correcting operation for the wind direction changing flap is performed without confusing a user.

In the seventh aspect of the present invention, the wind direction changing flap is returned to the reference position when the swing range of the wind direction changing flap is set. This way the starting point correcting operation for the wind direction changing flap is performed without confusing a user.

In the eighth aspect of the present invention, the wind direction changing flap is returned to the reference position while the wind direction changing flap is moving towards the reference position, instead of changing the moving direction of the wind direction changing flap moving away from the reference position. This way the starting point correcting operation for the wind direction changing flap is performed without confusing a user.

Further, in the ninth aspect of the present invention, the wind direction changing flap is moved to the proper swing range set according to the installation position, even if the wind direction changing flap is moved outside the swing range due to a mishandling by the user or the like.

BEST MODE FOR CARRYING OUT THE INVENTION

The following describes with reference to attached drawings an air conditioner of embodiments, according to the present invention.

Figure 1:
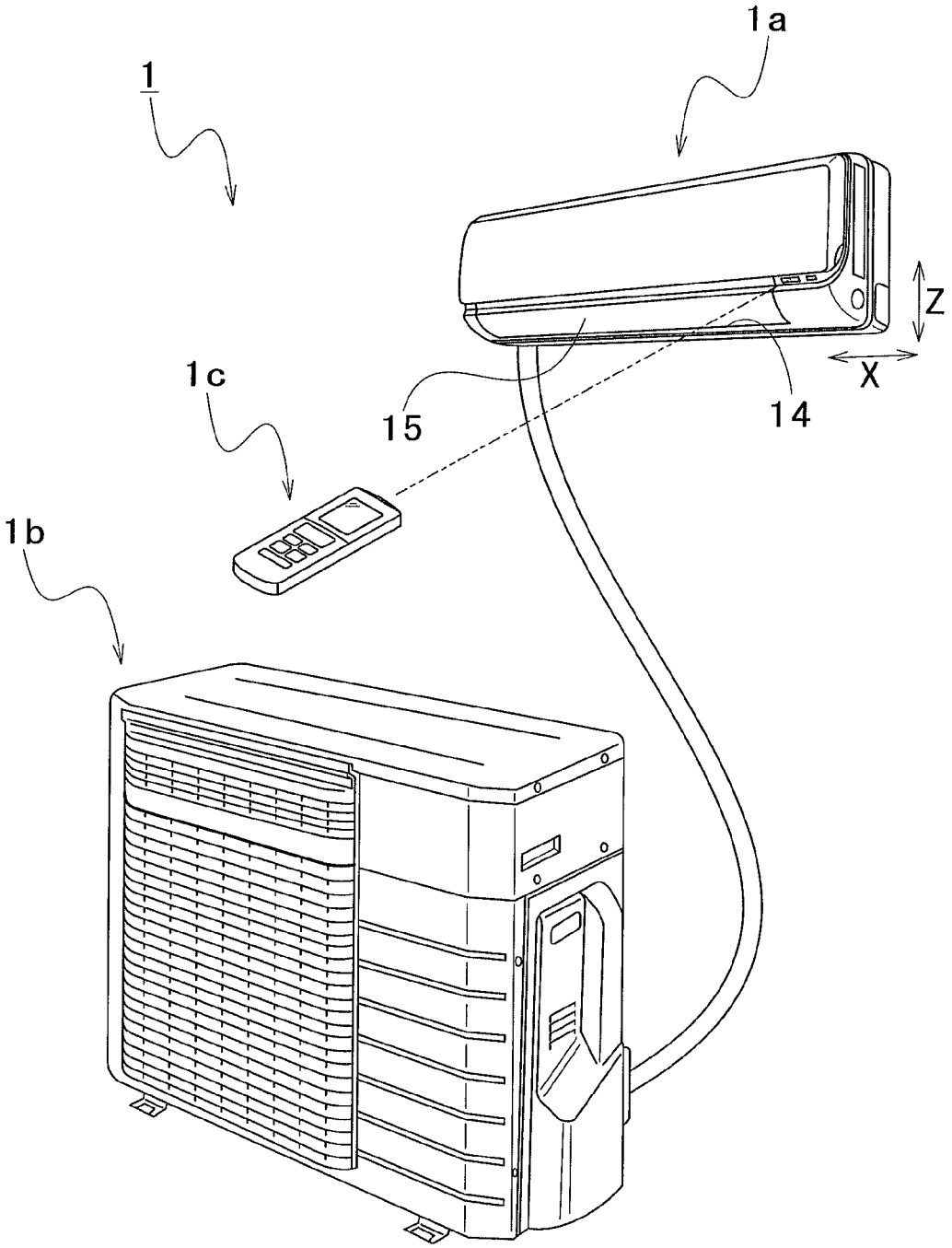
FIG. 1 is a perspective view showing the entire structure of an air conditioner of one embodiment, according to the present invention.

As shown in FIG. 1, an air conditioner 1 includes an indoor unit 1*a* installed on an indoor wall surface, an outdoor unit 1*b* installed outside the room, and a remote controller 1*c* capable of communicating with the indoor unit 1*a*.

<Indoor Unit>

Figure 2:
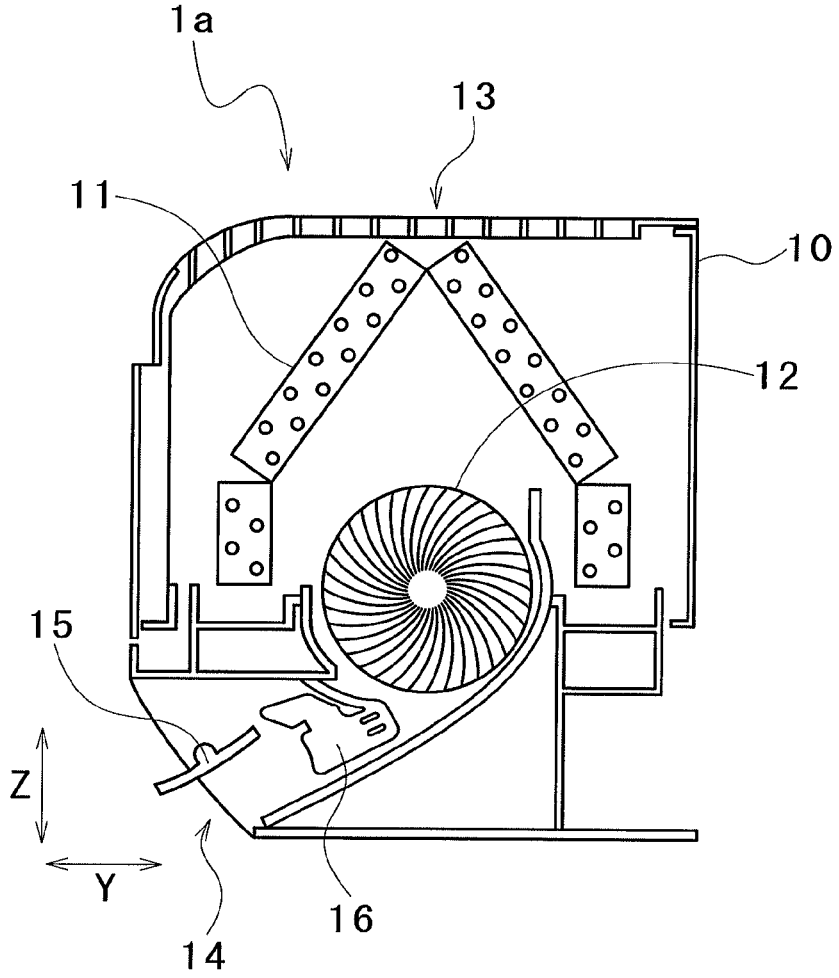
FIG. 2 is a side view showing an interior structure of an indoor unit.

As shown in FIG. 2, the indoor unit 1*a* mainly includes a casing 10, an indoor heat exchanger 11 and a fan 12 disposed inside the casing 10. In the upper portion of the casing 10 is provided an inlet port 13. In the lower portion of the casing 10 is provided an outlet port 14. When the fan 12 is driven, the indoor air is sucked into the inlet port 13. The air then passes the indoor heat exchanger 11 where the air is subjected to heat exchanging, and goes back into the room from the outlet port 14. In the passage extending from the fan 12 to the outlet port 14, an up/down flap 15 and a left/right flap 16 are disposed in this order from the side close to the outlet port 14.

The up/down flap 15 is provided for controlling the direction of the air blown out from the outlet port 14 in up/down directions (Z-directions (see FIG. 1 and FIG. 2)). This up/down flap 15 is reciprocable between the closed state in which the outlet port 14 is closed and the open state in which the outlet port 14 is opened. The movement of the up/down flap 15 is controllable by using the remote controller 1*c*, and when a "Up/Down Swing" or a "3-Dimensional Swing" is selected by the user through the remote controller 1*c*, the up/down flap 15 starts reciprocating in up/down directions. Note that the "Up/Down Swing" is a control to reciprocate only the up/down flap 15, where as the "3-Dimensional Swing" is a control to reciprocate the both up/down flap 15 and the left/right flap 16 at the same time.

Figure 3:
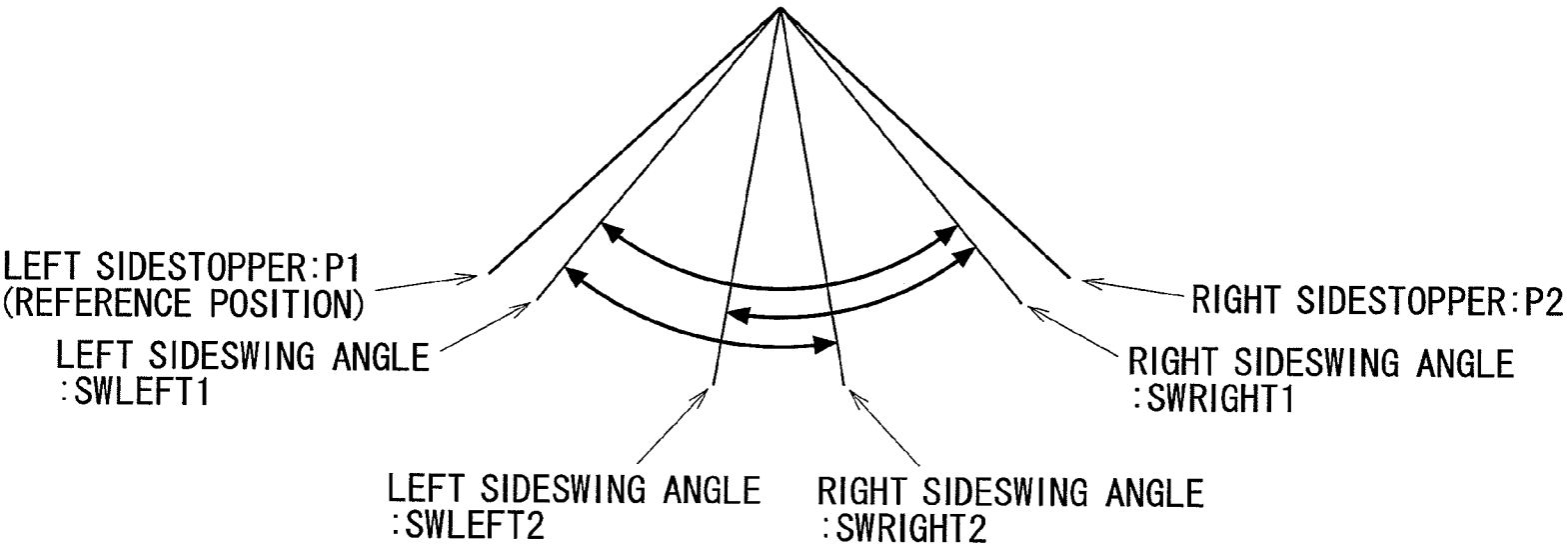
FIG. 3 is a schematic diagram showing a swing range and reference position of a left/right flap.

The left/right flap 16 is provided for controlling the direction of the air blown out from the outlet port 14 in left/right directions (X-directions (see FIG. 1)). As shown in FIG. 3, the left/right flap 16 is movable between a left side stopper P1 and a right side stopper P2 which define the range in which the left/right flap 16 moves. The range between the left side stopper P1 and the right side stopper P2 in which the left/right flap 16 is able to move is hereinafter referred to as "movable range". The movement of the left/right flap 16 is controllable by operating the remote controller 1*c*, and when a "Left/Right Swing" or the "3-Dimensional Swing" is selected by the user through the remote controller 1*c*, the left/right flap 16 reciprocates in left/right directions. Note that the "Left/Right Swing" is a control to reciprocate only the left/right flap 16.

Figure 4:
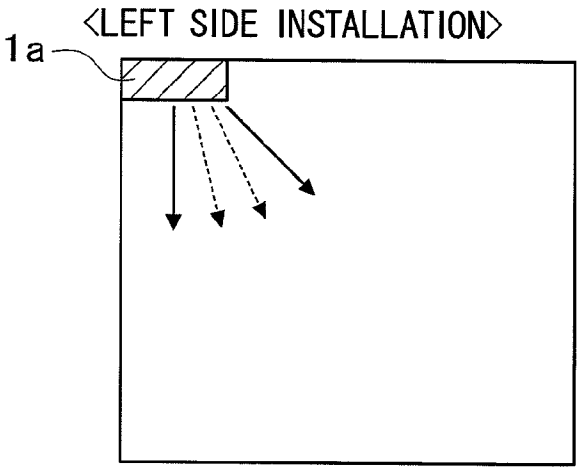
FIG. 4 is a schematic diagram showing a relation between an installation position of the indoor unit and the direction of the wind from the outlet port of the indoor unit.
Figure 4:
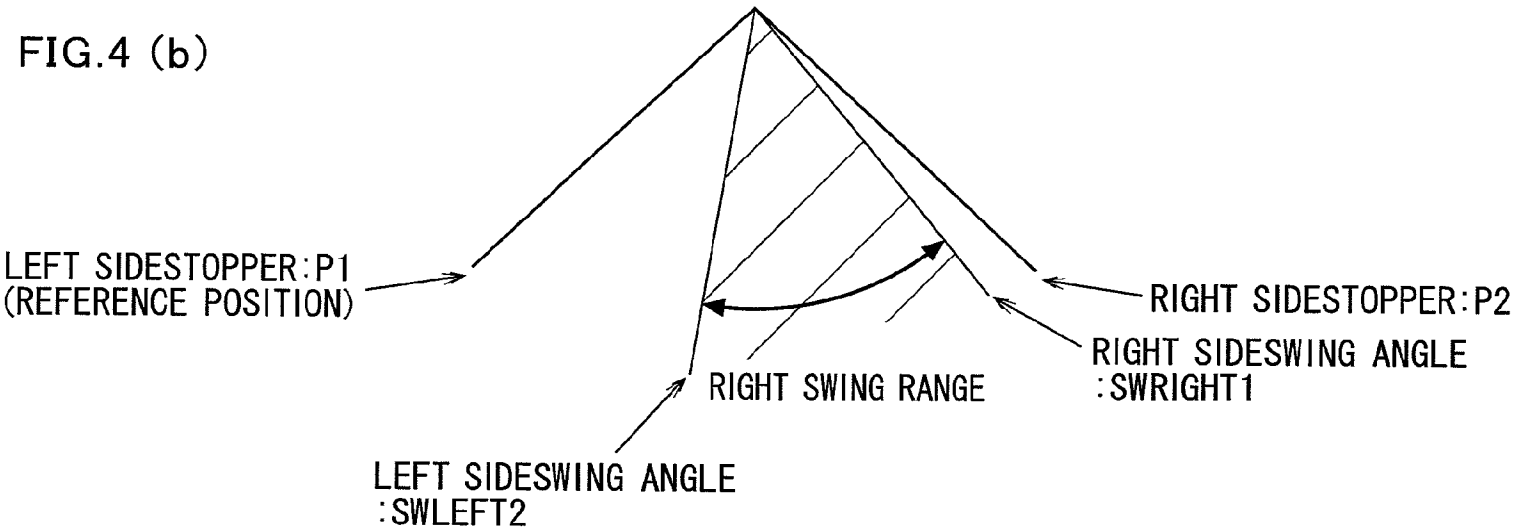
Figure 5:
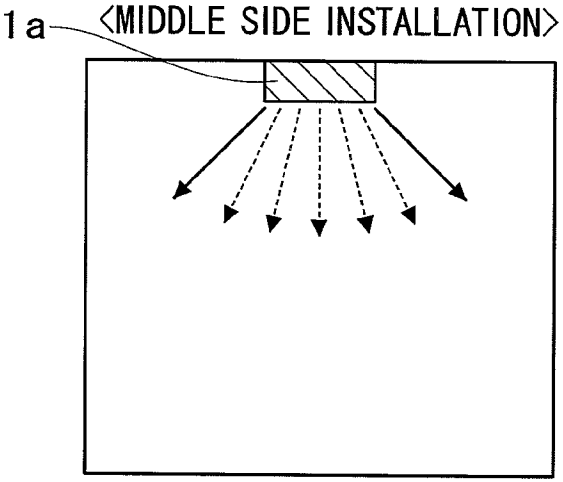
FIG. 5 is a schematic diagram showing a relation between an installation position of the indoor unit and the direction of the wind from the outlet port of the indoor unit.
Figure 5:
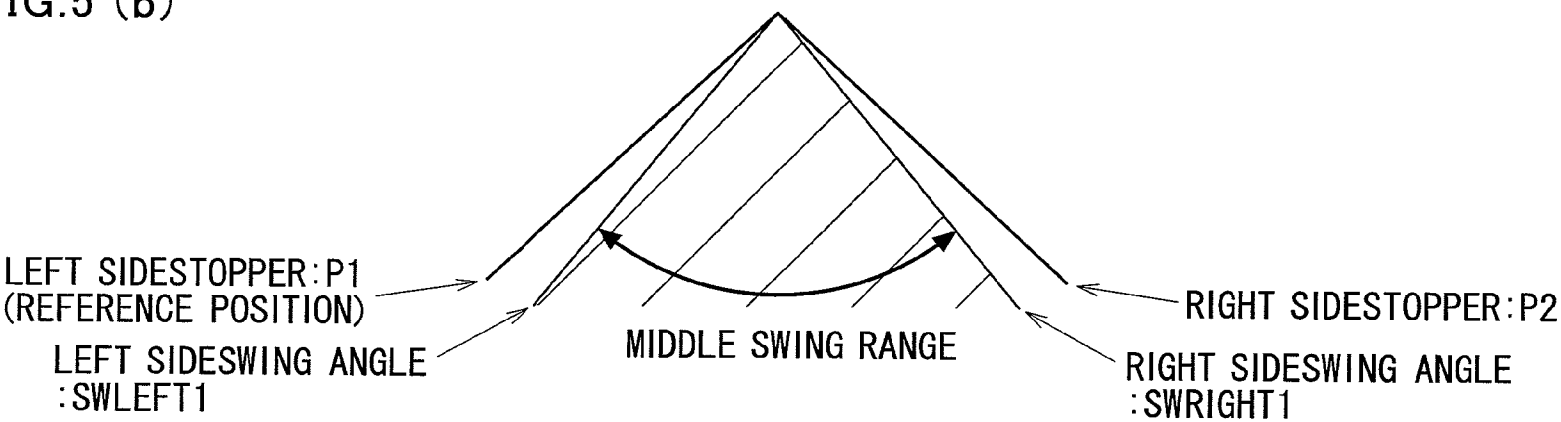
Figure 6:
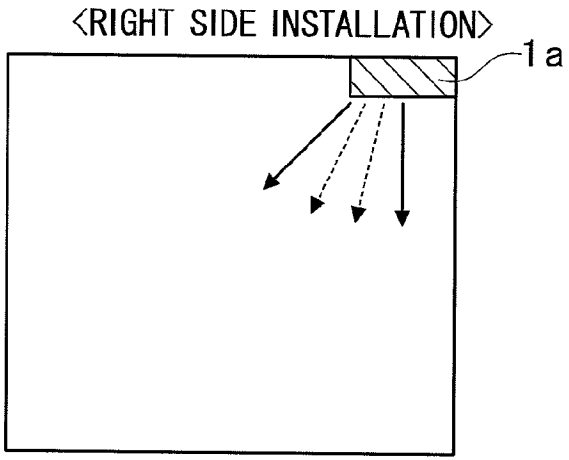
FIG. 6 is a schematic diagram showing a relation between the installation position of the indoor unit and the direction of the wind from the outlet port of the indoor unit.
Figure 6:
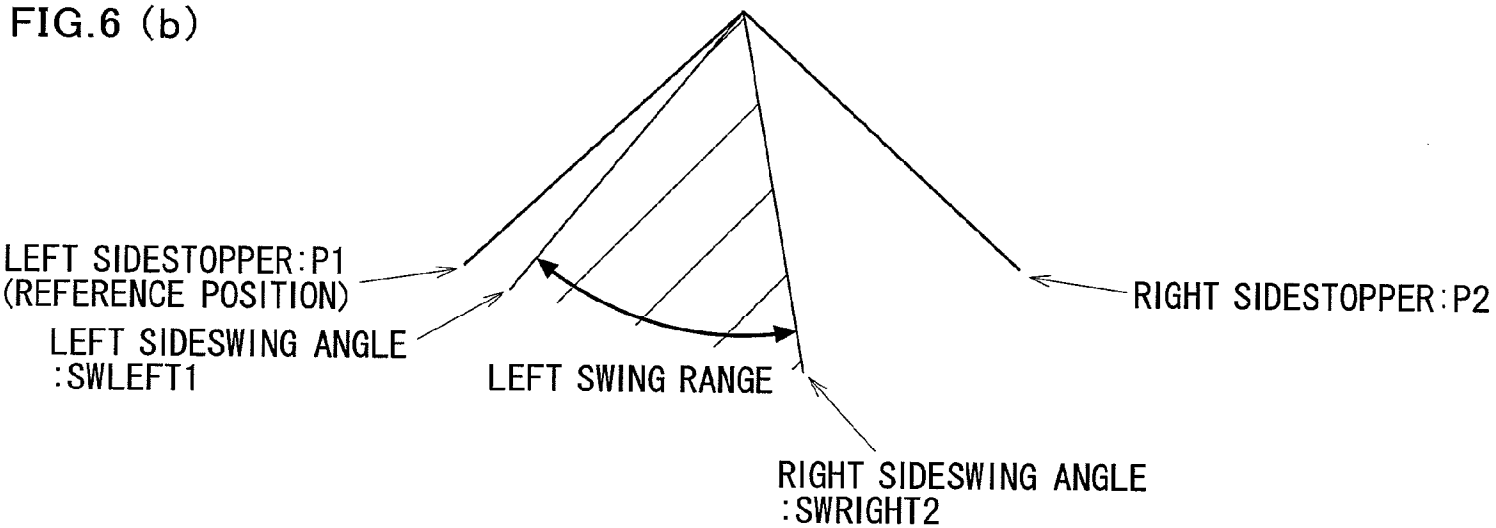

In the indoor unit 1*a* of the present embodiment, a left/right range of the wind direction from the outlet port 14 is set to a desirable range, according to the installation position of the indoor unit 1*a*. In other words, the indoor unit 1*a* allows setting of the range in which the left/right flap 16 moves to a part of the movable range mentioned hereinabove, according to the installation position. This set range in which the left/right flap 16 moves is hereinafter referred to as "swing range". Specifically, as shown in FIG. 4, when the indoor unit 1*a* is installed on the left side of an indoor wall surface (left side installation), the swing range of the left/right flap 16 is restricted to a range from the right side swing angle (SWRIGHT1) to the left side swing angle (SWLEFT2) (the range is hereinafter referred to as "right swing range") so that the air blown out flows towards the right side of the room. Further, as shown in FIG. 5, when the indoor unit 1*a* is installed in the middle of the indoor wall surface (middle installation), the swing range of the left/right flap is restricted to a range from the left side swing angle (SWLEFT1) to the right side swing angle (SWRIGHT1) (the range is hereinafter referred to as "middle swing range") so that the air blown out from the outlet port 14 flows evenly towards the left and right sides. Further, as shown in FIG. 6, when the indoor unit 1*a* is installed on the right side of the indoor wall surface (right side installation), the swing range of the left/right flap 16 is limited to a range from the left side swing angle (SWLEFT1) to the right side swing angle (SWRIGHT2) (the range is hereinafter referred to as "left swing range") so that the air blown out flows towards the left side of the room.

<Remote Controller>

Figure 7:
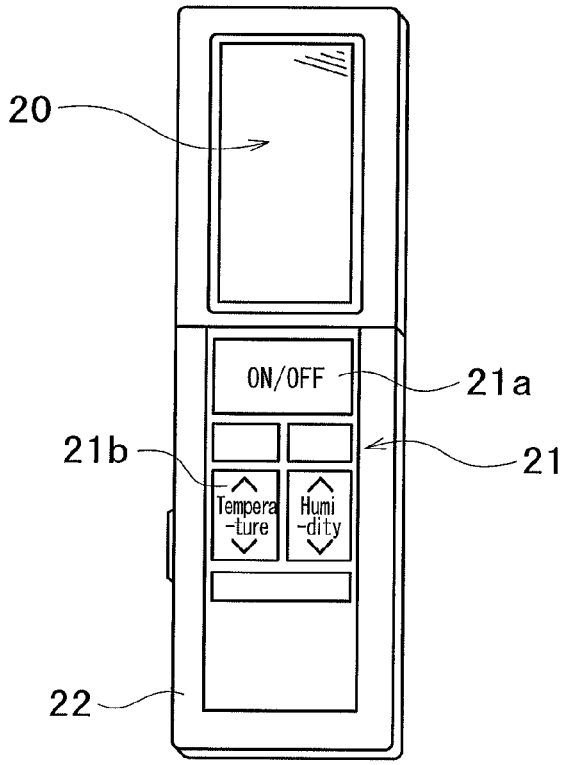
FIG. 7 is a front view showing a remote controller with its cover portion closed.
Figure 8:
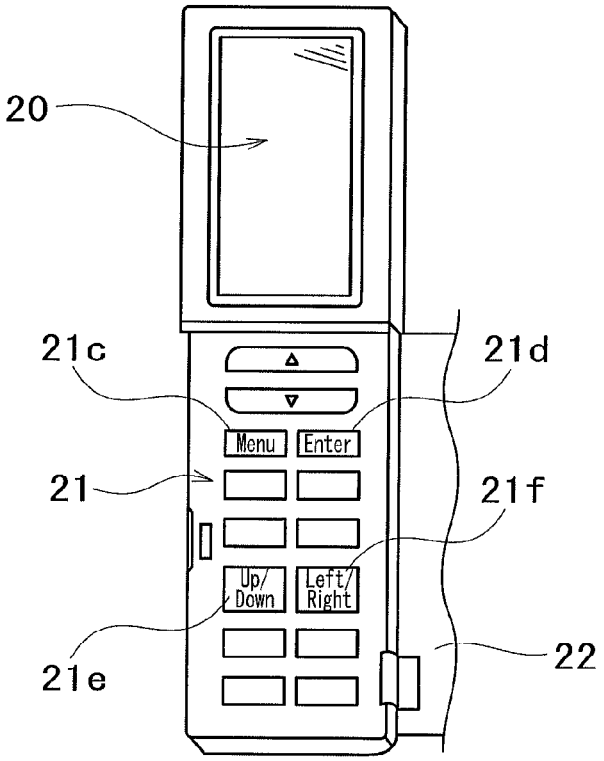
FIG. 8 is a front view showing the remote controller with the cover portion opened.

The remote controller 1*c* is capable of performing infrared communications with the indoor unit 1*a*, and transmits various commands related to control of the indoor unit 1*a* and the outdoor unit 1*b*, according to an operation by a user. As shown in FIG. 7 and FIG. 8, the remote controller 1*c* mainly includes a display unit 20 which displays an indoor temperature, a set temperature, or the like; and an operation unit 21 having various buttons. The operation unit 21 has a power-on/power-off button 21*a*; a temperature adjustment button 21*b* used for changing the set temperature, or the like which are disposed outside the cover portion 22 capable of being opened/closed (see FIG. 7, or the like). The operation unit 21 also has a menu button 21*c*; an entry button 21*d*; a wind direction changing button (up/down wind direction button 21*e*, left/right wind direction button 21*f*), or the like which are disposed inside the cover portion 22 (see FIG. 8).

The "Up/Down Swing" is set by pressing the up/down wind direction button 21*e* disposed on the operation unit 21. The "Left/Right Swing" is set by pressing the left/right wind direction button 21*f* disposed on the operation unit 21. The "3-Dimensional Swing" is set by pressing the up/down wind direction button 21*e* and the left/right wind direction button 21*f*.

Figure 9:
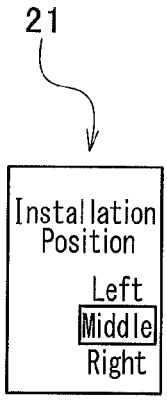
FIG. 9 shows an installation position selecting screen displayed on a display unit of the remote controller.

In the present embodiment, to set the swing range of the left/right flap 16 to a part of the movable range according to the installation position of the indoor unit 1*a*, the menu button 21*c* (see FIG. 8) disposed on the operation unit 21 is pressed to display an installation position selecting screen (see FIG. 9) on the display unit 20, and one of "Left", "Middle", and "Right" displayed in the screen is selected by using the entry button 21*d* (see FIG. 8). When the "Left" is selected, the indoor unit 1*a* recognizes the left side installation, and the swing range of the left/right flap 16 is set to a right swing range (see FIG. 4(*b*)). When the "Middle" is selected, the indoor unit 1*a* recognizes the middle installation, and the swing range of the left/right flap 16 is set to a middle swing range (see FIG. 5(*b*)). When the "Right" is selected, the indoor unit 1*a* recognizes the right side installation, and the swing range of the left/right flap 16 is set to a left swing range (see FIG. 6(*b*)).

Figure 10:
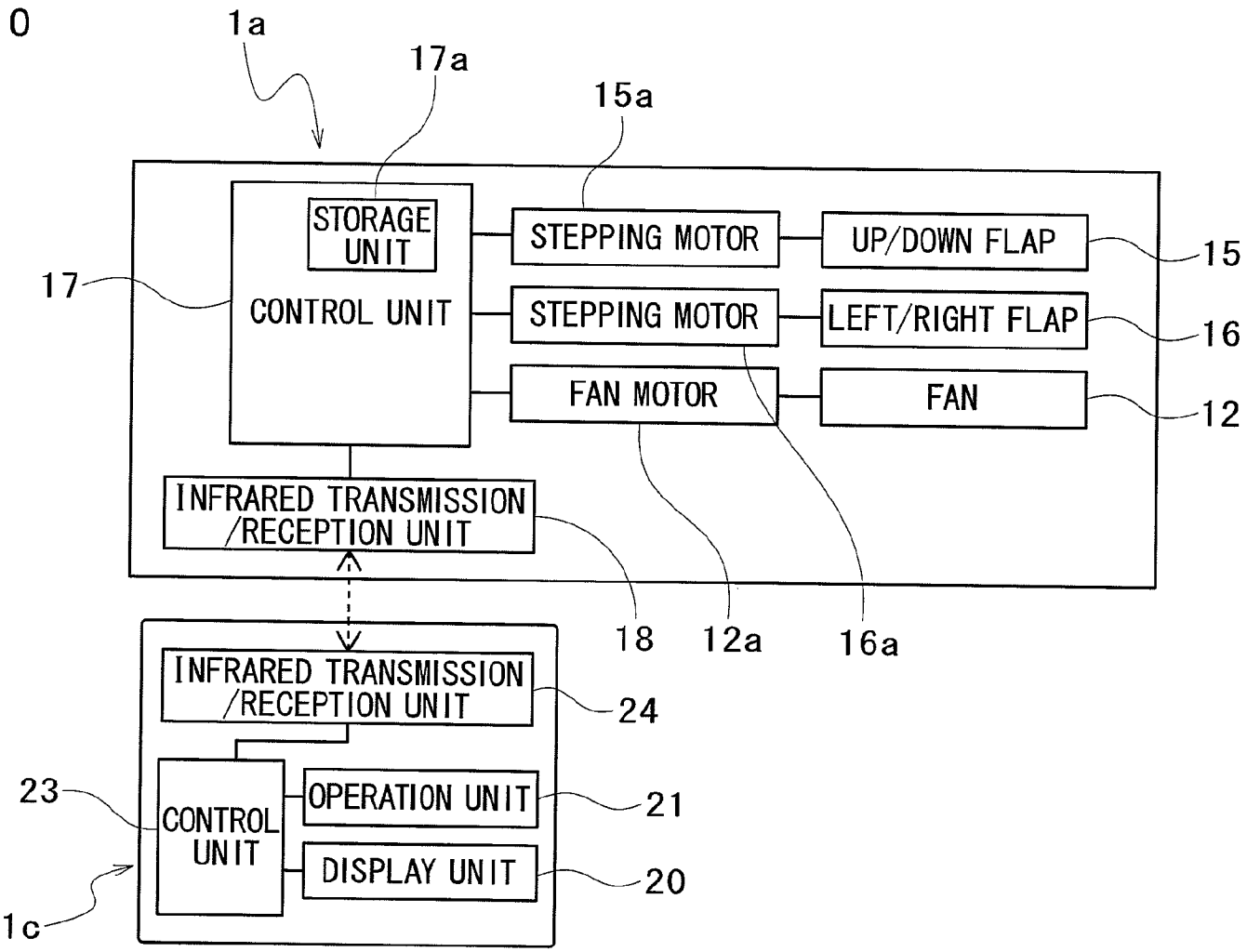
FIG. 10 is a diagram showing respective control blocks of the indoor unit of the air conditioner shown in FIG. 1 and the remote controller.

Next, with reference to FIG. 10, the following describes the control blocks of the indoor unit 1*a* and the remote controller 1*c*.

The remote controller 1*c* is provided with a control unit 23 which controls an operation of each unit in the remote controller 1*c*. This control unit 23 is connected to the operation unit 21, the display unit 20, and an infrared transmission/reception unit 24.

Further, the indoor unit 1*a* is provided with a control unit 17 which controls an operation of each unit in the indoor unit 1*a*. This control unit is connected to a stepping motor 15*a* which moves the up/down flap 15, a stepping motor 16*a* which moves the left/right flap 16, a fan motor 12*a* which spins the fan 12, an infrared transmission/reception unit 18 to be connected and be in communication with the infrared transmission/reception unit 24 of the remote controller 1*c*. The stepping motors 15*a* and 16*a* are driven under the control of pulse signals transmitted from the control unit 17.

In the present embodiment, the control unit 17 controls the movement of the up/down flap 15 and the left/right flap 16, based on the number of pulse signals transmitted to the stepping motors 15*a* and 16*a*. The number of pulse signals transmitted to the stepping motors 15*a* and 16*a* is stored in the storage unit 17*a* and the positions of the up/down flap 15 and the left/right flap 16 are grasped based on the number of pulse signals stored.

The storage unit 17*a* further stores the moving direction of the left/right flap 16 (i.e., the rotating direction of the stepping motor 16*a*), and the control unit 17 manages the direction in which the left/right flap 16 moves based on the moving direction stored in the storage unit 17*a*. This enables control such that the moving direction of the left/right flap 16 at the end of its previous movement is the moving direction at the beginning of its current movement (hereinafter, initial moving direction of the left/right flap 16).

In the present embodiment, the control unit 17 sets, based on the number of pulse signals, the swing range to one of the "right swing range", the "middle swing range", and the "left swing range" each of which is defined based on the distance from the reference position P1 (see FIG. 3). Specifically, when the swing range is set, according to the number of pulse signals, to the "right swing range" which is defined based on the distance from the reference position P1, the control unit 17 sets the swing range based on the number of pulse signals corresponding to the right side swing angle (SWRIGHT1) and the number of pulse signals corresponding to the left side swing angle (SWLEFT2). Further, when the swing range is set, according to the number of pulse signals, to the "middle swing range" which is defined based on the distance from the reference position P1, the control unit 17 sets the swing range based on the number of pulse signals corresponding to the left side swing angle (SWLEFT1) and the number of pulse signals corresponding to the right side swing angle (SWRIGHT1). Further, when the swing range is set, according to the number of pulse signals, to the "left swing range" which is defined based on the distance from the reference position P1, the control unit 17 sets the swing range based on the number of pulse signals corresponding to the left side swing angle (SWLEFT1) and the number of pulse signals corresponding to the right side swing angle (SWRIGHT2). Note that the "reference position" is one end of the movable range in which the left/right flap 16 moves, and corresponds to the left side stopper P1 of the left/right flap 16. When the left/right flap 16 is moved despite the absence of pulse signals (e.g. when the left/right flap 16 is mistakenly moved by a hand of the user), the swing range in which the left/right flap 16 actually moves may be different from the swing range expected by the control unit 17.

In view of this, when the swing range of the left/right flap 16 is set to the "right swing range", the "middle swing range", or the "left swing range", the control unit 17 once returns the left/right flap 16 to the reference position P1 before moving the same in the present embodiment. When the swing range is set to one of the "right swing range", the "middle swing range", or and the "left swing range", the timing of returning the left/right flap 16 to the reference position P1 is when the operation of the indoor unit 1*a* is started. The storage unit 17*a* stores information indicating whether or not one of the "Left/Right Swing" and the "3-Dimensional Swing" is set. Therefore, the control unit 17 at the time of starting the operation of the indoor unit 1*a* confirms whether or not one of the "Left/Right Swing" or the "3-Dimensional Swing" is set. If one of them is set, the left/right flap 16 is once returned to the reference position P1, and then reciprocated within the set swing range.

Figure 11:
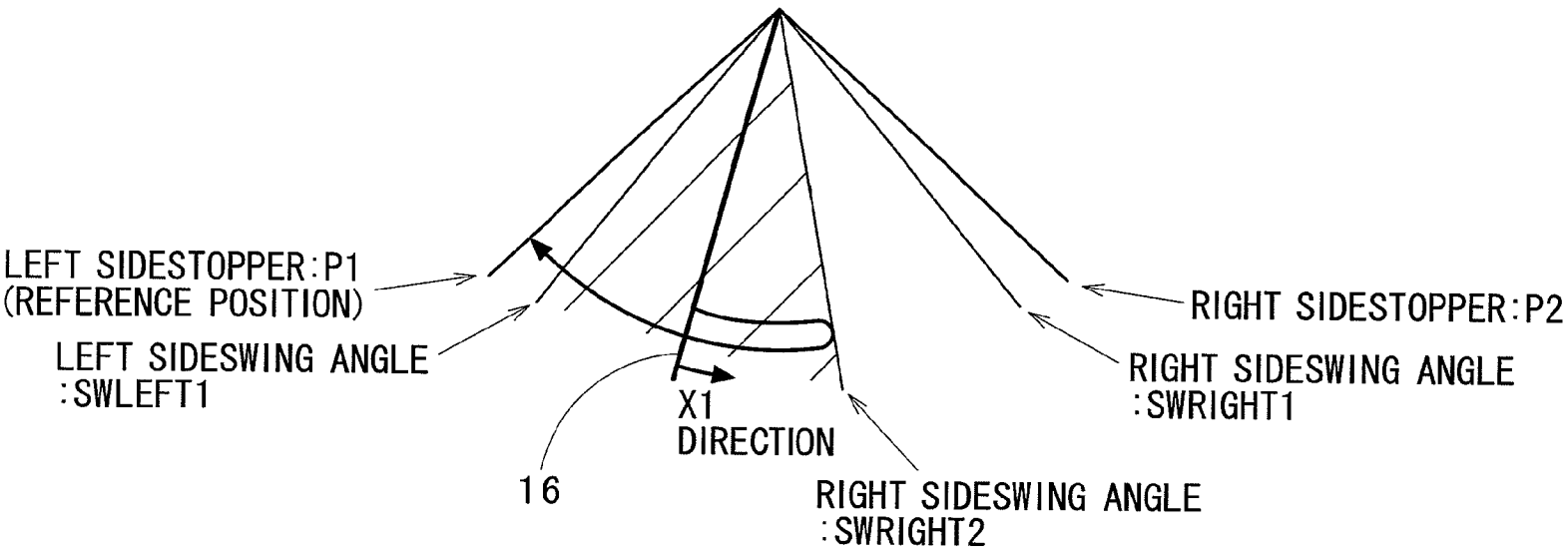
FIG. 11 is a schematic diagram showing a relation between the initial moving direction of the left/right flap and the starting point correcting operation.
Figure 12:
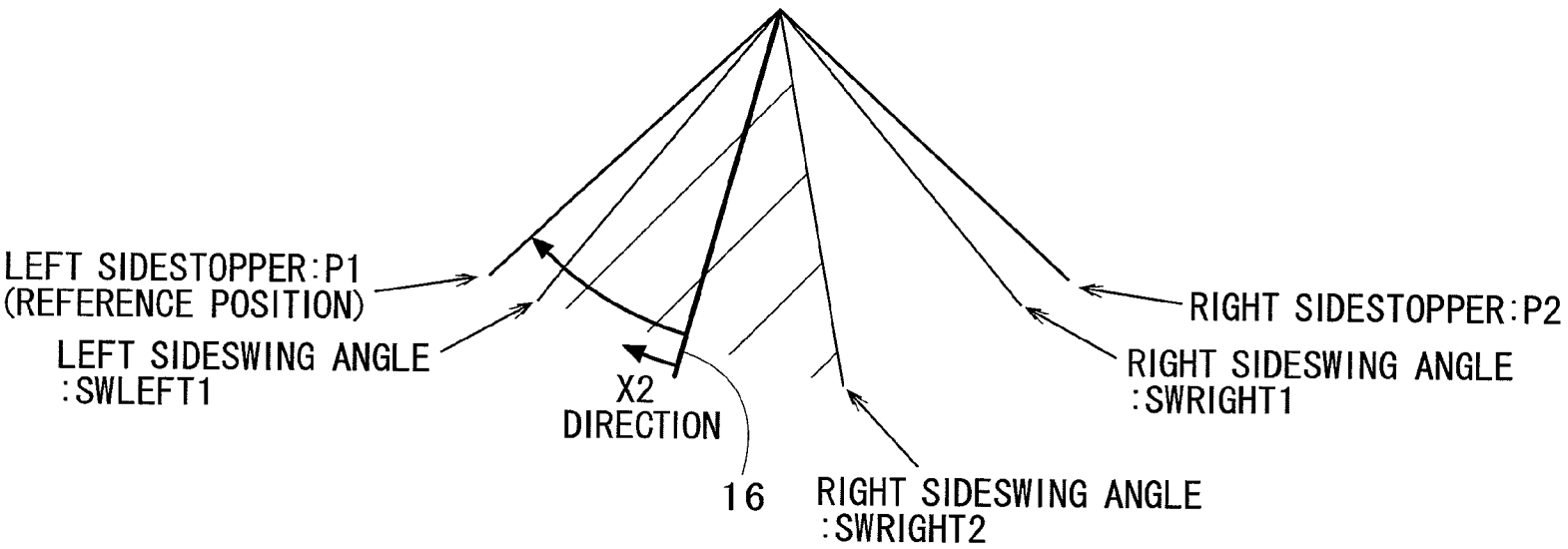
FIG. 12 is a schematic diagram showing a relation between the initial moving direction of the left/right flap and the starting point correcting operation.

Further, in the present embodiment, the control unit 17 returns the left/right flap 16 to the reference position P1 while the left/right flap 16 is moving towards the reference position P1. In other words, when the initial moving direction of the left/right flap 16 is a direction away from the reference position P1 (X1 direction) as shown in FIG. 11, the left/right flap 16 is moved to the end of the swing range relative to the X1 direction (the right side swing angle in FIG. 11: SWRIGHT2) and then returned to the reference position P1. When the initial moving direction of the left/right flap 16 is a direction towards the reference position P1 (X2 direction) as shown in FIG. 12, the left/right flap 16 is returned directly to the reference position P1. After the left/right flap 16 is returned to the reference position P1, the left/right flap 16 is swung within the swing range instructed by the number of pulse signals, the swing range defined based on the distance from the reference position P1.

Figure 13:
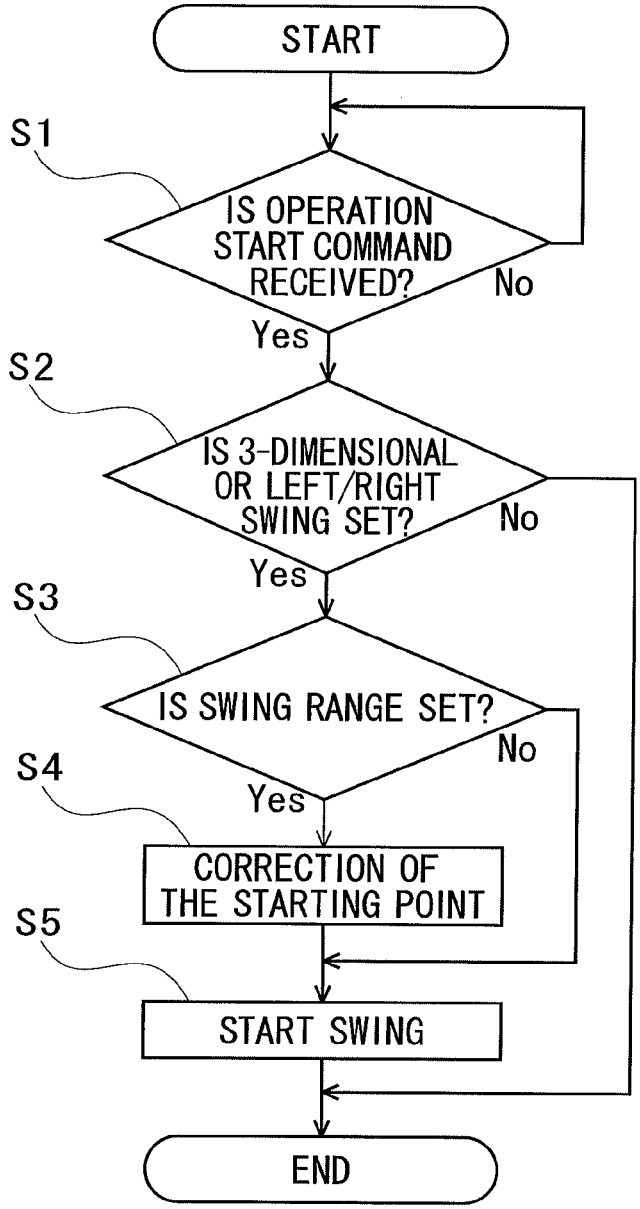
FIG. 13 is a flowchart explaining the starting point correcting operation of the left/right flap of First Embodiment, according to the present invention.

Next, with reference to FIG. 13, the following describes a starting point correcting operation for the left/right flap 16 according to a first embodiment.

First, the control unit 17 of the indoor unit 1*a* determines whether or not an operation start command to start the operation of the indoor unit 1*a* is received (step S1). When the control unit 17 determines that the operation start command is received from the remote controller 1*c* (step S1: Yes), the control unit 17 determines whether or not one of the "3-Dimensional Swing" and the "Left/Right Swing" is set in relation to the movement of the left/right flap 16 (step S2). If one of the "3-Dimensional Swing" and the "Left/Right Swing" is set (step S2: Yes), the control unit 17 determines whether or not the swing range of the left/right flap 16 is set to a part of the movable range (step S3). In other words, in the present embodiment, the control unit 17 determines whether or not the swing range of the left/right flap 16 is set to one of the "right swing range", the "middle swing range", and the "left swing range" based on the setting of the installation position of the indoor unit 1*a* (step S3).

On the other hand, when none of the "3-Dimensional Swing" or the "Left/Right Swing" is set (step S2: No), the left/right flap 16 is not reciprocated. Therefore, the process ends without the correction of the starting point of the left/right flap 16 (step S2: No).

In step S3, if the swing range of the left/right flap 16 is set (step S3: Yes), the control unit 17 once returns the left/right flap 16 to the reference position P1 (step S4), and then start the reciprocation of the left/right flap 16 within the swing range instructed by the number of pulse signals, the range being defined based on the distance from the reference position P1 (step S5).

On the other hand, when the swing range of the left/right flap 16 is not set (step S3: No), reciprocation of the left/right flap 16 is started (step S5) without the starting point correcting operation (step S4). In this case, the left/right flap 16 reciprocates within a movable range in which the left/right flap 16 is able to move. Since the movement of the left/right flap 16 is therefore restricted by the stoppers P1 or P2, the correction of the starting point of the left/right flap 16 is automatically done, without a need of control to return the left/right flap 16 to the reference position P1.

The starting point correcting operation for the left/right flap 16 is performed as described hereinabove when the "3-Dimensional Swing" or the "Left/Right Swing" in relation to the movement of the left/right flap 16 is set and the installation position of the indoor unit 1*a* is set (i.e., the swing range is set to one of the "right swing range", the "middle swing range", and the "left swing range") before the operation of the air conditioner.

<Characteristics of Air Conditioner of First Embodiment>

The air conditioner 1 of the present embodiment has the following characteristics.

In the air conditioner 1 of the present embodiment, the left/right flap 16 is once returned to the reference position P1 when the swing range of the left/right flap 16 is set. Therefore, the left/right flap 16 is prevented from moving outside the swing range. This enables the left/right flap 16 to move within a proper swing range having been set, even if the left/right flap 16 is moved by mishandling by a user or the like.

Further, in the air conditioner 1 of the present embodiment, each of the swing ranges is defined based on the distance from the reference position P1, and is associated with the number of pulses. Thus, once returning the left/right flap 16 to the reference position P1 makes it easier to have the left/right flap 16 move within the swing range instructed by the number of pulses, the swing range being defined based on the distance from the reference position P1.

Further, in the air conditioner 1 of the present embodiment, the reference position P1 is set at an end of the movable range serving as the starting point of reciprocation of the left/right flap 16. This way the left/right flap 16 is reliably returned to the reference position P1.

Further, in the air conditioner 1 of the present embodiment, the left/right flap 16 is returned to the reference position P1 when the operation of the air conditioner is started. This way the starting point correcting operation for the left/right flap 16 is performed without confusing the user.

Further, in the air conditioner 1 of the present embodiment, the left/right flap 16 is returned to the reference point P1 while the left/right flap 16 is moving towards the reference position P1, instead of changing the moving direction of the left/right flap 16 moving in a direction away from the reference position P1. This way the starting point correcting operation for the left/right flap 16 is performed without confusing the user.

Further, with the air conditioner 1 of the present embodiment, the left/right flap 16 moves within a proper swing range set according to the installation position, even if the left/right flap 16 is moved outside the swing range due to mishandling by the user or the like.

Second Embodiment

Figure 14:
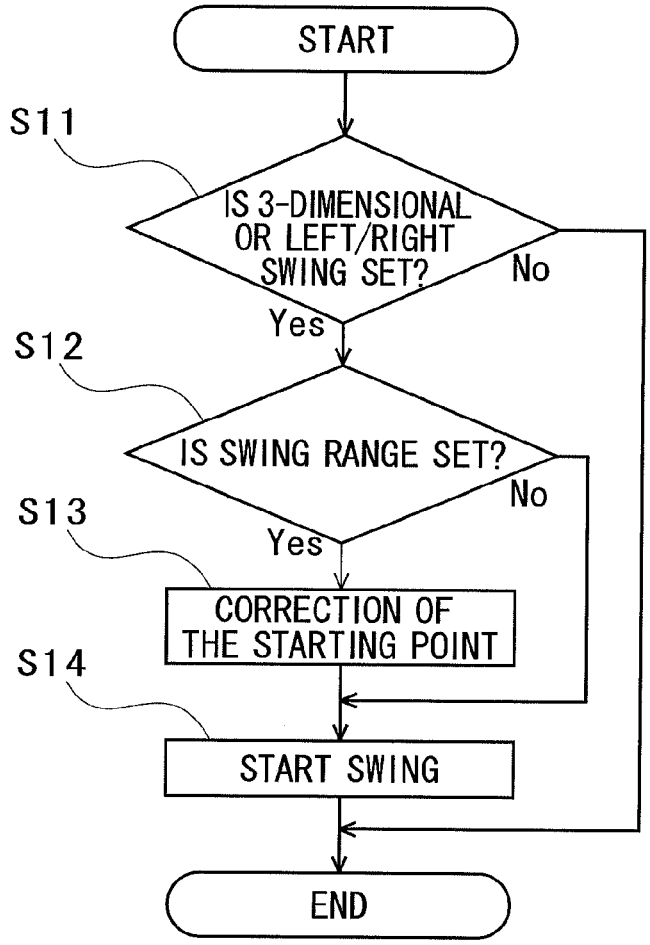
FIG. 14 is a flowchart explaining the starting point correcting operation of the left/right flap of Second Embodiment, according to the present invention.

Next, with reference to FIG. 14, the following describes a starting point correcting operation for the left/right flap 16*a* according to a second embodiment. Note that an air conditioner of the second embodiment is different from that of the first embodiment in the timing of performing the starting point correcting operation for the left/right flap 16.

While the air conditioner 1 is operated and the left/right flap 16 is stopped, the control unit 17 determines whether or not a 3-Dimensional Swing command or a Left/Right Swing command is received from the remote controller 1*c* (step S11). The "3-Dimensional Swing command" is a signal transmitted when the up/down wind direction button 21*e* (see FIG. 8) or the left/right wind direction button 21*f* (see FIG. 8) in the operation unit 21 of the remote controller 1*c* is pressed. The "Left/Right Swing command" is a signal transmitted when the left/right wind direction button 21*f* disposed in the operation unit 21 of the remote controller 1*c* is pressed. When the control unit 17 determines that the 3-Dimensional Swing command or the Left/Right Swing command is received (step S11: Yes), the control unit 17 determines whether or not the swing range of the left/right flap 16 is set to a part of the movable range (step S12). That is, in the present embodiment, the control unit 17 determines whether or not the swing range of the left/right flap 16 is set to one of the "right swing range", the "middle swing range", and the "left swing range" based on the setting of the installation position of the indoor unit 1*a* (step S12).

When the 3-Dimensional Swing command or the Left/Right Swing command is not received (step S11: No), the left/right flap 16 is not reciprocated. Therefore, the process ends without performing the correction of the starting point for the left/right flap 16 (step S11: No).

In step S12, when the swing range of the left/right flap 16 is set (step S12: Yes), the control unit 17 once returns the left/right flap 16 to the reference position P1 (step S13) and then starts reciprocation of the left/right flap 16 within the swing range instructed by the number of pulse signals, the swing range defined based on the distance from the reference position P1 (step S14).

On the other hands, when the swing range of the left/right flap 16 is not set (step S12: No), reciprocation of the left/right flap 16 is started (step S14) without the starting point correcting operation (step S13). In this case, the left/right flap 16 reciprocates within a movable range in which the left/right flap 16 is able to move. Since the movement of the left/right flap 16 is restricted by the stoppers P1 or P2, the correction of the starting point of the left/right flap 16 is automatically done, without a need of control to return the left/right flap 16 to the reference position P1.

The starting point correcting operation for the left/right flap 16 is performed as described above, when the "3-Dimensional Swing" or the "Left/Right Swing" is set in relation to the movement of the left/right flap 16, and when the installation position of the indoor unit 1*a* is set (when the swing range is set to any one of the "right swing range", the "middle swing range", and the "left swing range") during the operation of the air conditioner.

<Characteristics of Air Conditioner of Second Embodiment>

The air conditioner of the present embodiment has the following characteristics.

In the air conditioner of the present embodiment, the left/right flap 16 is returned to the reference position P1 at the time of starting the movement of the left/right flap 16 during the operation of the air conditioner. This way the starting point correcting operation for the left/right flap 16 is performed without confusing a user.

Third Embodiment

Figure 15:
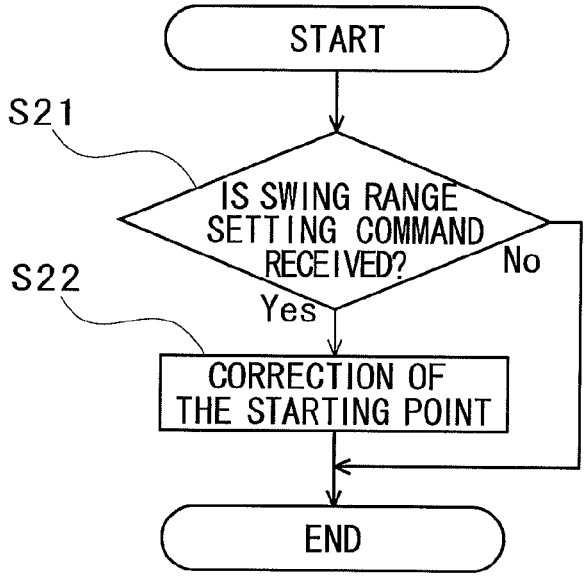
FIG. 15 is a flowchart explaining the starting point correcting operation of the left/right flap of Third Embodiment, according to the present invention.

Next, with reference to FIG. 15, the following describes a starting point correcting operation for the left/right flap according to a third embodiment. Note that an air conditioner of the third Embodiment is different from that of the first and second embodiments in the timing of performing the starting point correcting operation for the left/right flap 16.

The control unit 17 of the indoor unit 1*a* determines whether or not a swing range setting command is received from the remote controller 1*c* (step S11). This "swing range setting command" is a signal transmitted when any one of the "Left", "Middle", and "Right" in the installation position selecting screen (see FIG. 9) is selected by using the entry button 21*d* (see FIG. 8). When the control unit 17 determines that the swing range setting command is received (step S21: Yes), the control unit 17 once returns the left/right flap 16 to the reference position P1 (step S22).

That is, in this air conditioner, the starting point correcting operation for the left/right flap 16 is performed when the swing range is set to any one of the "right swing range", the "middle swing range", and the "left swing range".

<Characteristics of Air Conditioner of Third Embodiment>

The air conditioner of the present embodiment has the following characteristics.

In the air conditioner of the present embodiment, the left/right flap 16 is returned to the reference position P1 when the swing range of the left/right flap 16 is set. This way the starting point correcting operation for the left/right flap 16 is performed without confusing the user.

Fourth Embodiment

Figure 16:
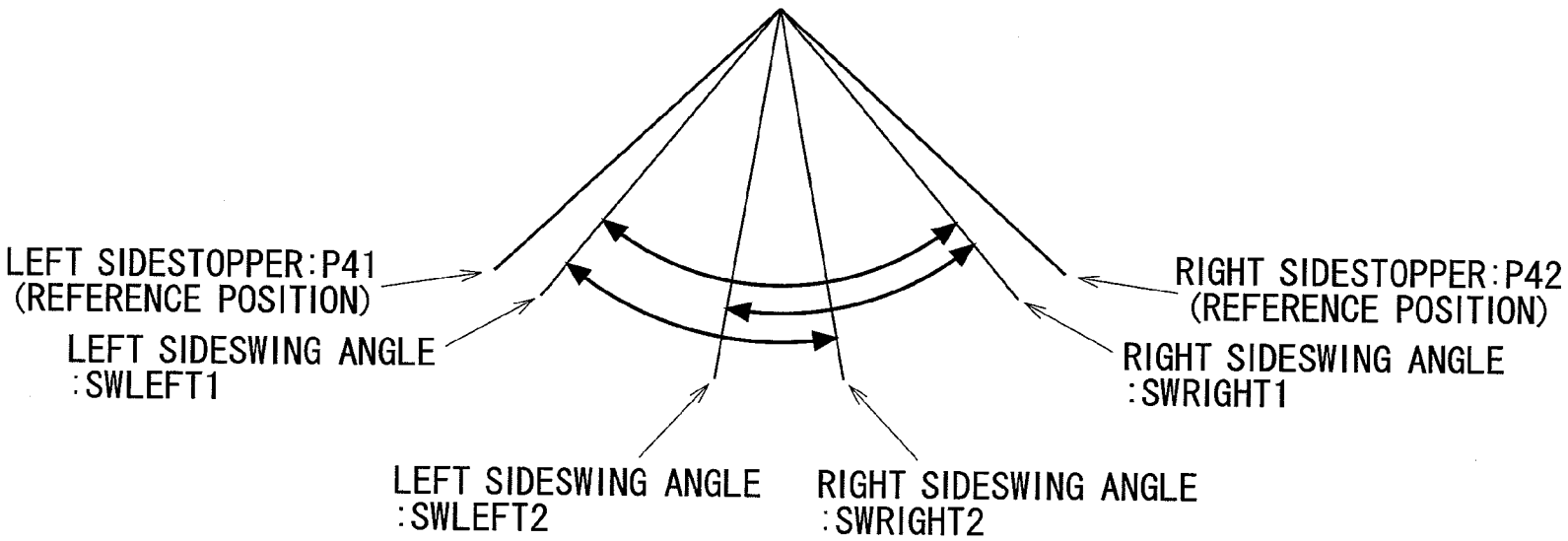
FIG. 16 is a schematic diagram showing the swing range and the reference position of the left/right flap of the air conditioner of Fourth Embodiment, according to the present invention.

Next, with reference to FIG. 16, the following describes an air conditioner of a fourth embodiment.

In the air conditioner, the left/right flap 16 is able to move from a left side stopper P41 at one end of the movable range in which the left/right flap 16 is able to move, to a right side stopper P42 at the other end of the movable range, as shown in FIG. 16. In the present embodiment, reference positions P41 and P42 are on both sides of the swing ranges ("right swing range", "middle swing range", "left swing range"), respectively, and these reference positions P41 and P42 serve as a position to which the left/right flap 16 is once returned in the correction of the starting point of the left/right flap 16.

<Characteristics of Air Conditioner of Fourth Embodiment>

The air conditioner of the present embodiment has the following characteristics.

The air conditioner of the present embodiment has the reference positions P41 and P42 on both sides of the swing ranges, respectively. This way the left/right flap 16 is returned to one of the reference positions which is close to the left/right flap 16. Specifically, it is possible to set the left side stopper P41 as the reference position when the swing range is set to the "left swing range", and set the right side stopper P42 as the reference position when the swing range is set to the "right swing range". This shortens the time needed to return the left/right flap 16 to the reference position, as compared with the case of providing only one reference position. This way the starting point correcting operation for the left/right flap 16 is performed without confusing a user.

Thus, embodiments of the present invention is described hereinabove with reference to the attached drawings. The present invention however should not be limited to the above embodiments. The scope of the present invention is defined not only by the above description of the embodiments, but also by the claims set forth hereinbelow, and shall encompass various modifications within the scope defined in claims and those which are equivalent to the claims.

For example, the above embodiments deals with cases where the swing ranges (the "right swing range", the "middle swing range", and the "left swing range") are defined based on the distance from the reference position P1, and where each of the swing ranges is associated with the number of pulse signals. The present invention however is not limited to this, and the swing ranges may be defined based on the angle with respect to the reference position or duration of the movement from the reference position. In present invention, the wind direction changing flap (left/right flap) is once returned to the reference position. Therefore, in any case the wind direction changing flap (left/right flap) is swung within a proper swing range.

Figure 17:
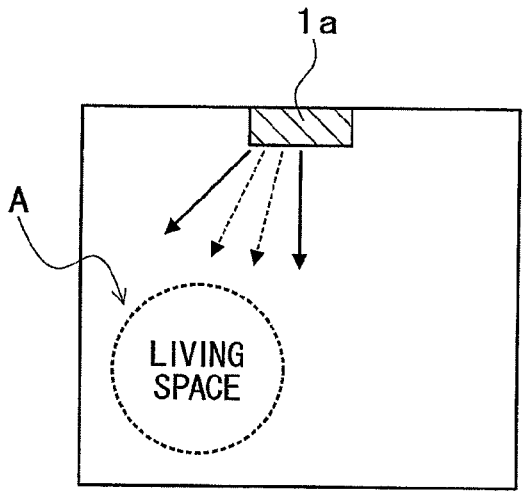
FIG. 17 is a schematic diagram showing a relation between a modification of the indoor unit whose swing range has been set and the direction of the wind from the outlet port of the indoor unit.
Figure 18A:
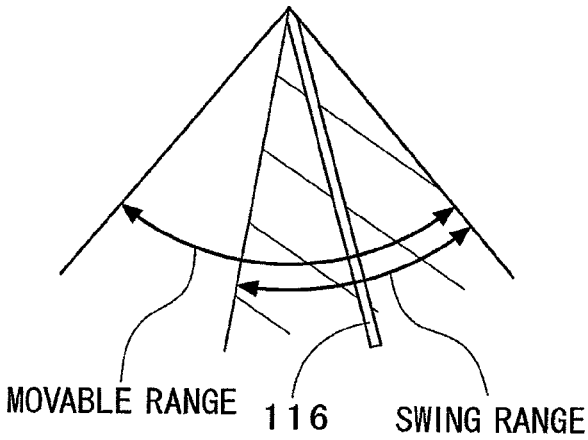
FIG.18(a) Conventional Art
FIG. 18 is a schematic diagram explaining the problem of displacement in the swing range in a traditional air conditioner.
Figure 18B:
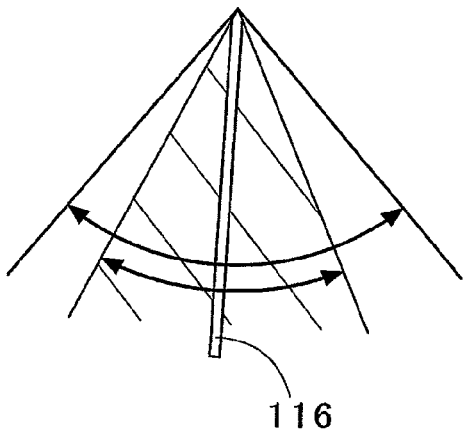
FIG.18(b) Conventional Art

Further, the above embodiments deals with cases where the swing range of the left/right flap is set based on the installation position of the indoor unit. However, the present invention is not limited to this. For example, the swing range of the left/right flap may be settable by a user to any of the given ranges, irrespective of the installation position of the indoor unit. This is advantageous in cases where the room has one-sided living space as is shown in FIG. 17. Thus, even if the installation position of the indoor unit is not set, the present invention in which the left/right flap is returned to the reference position at the time of moving the left/right flap is applicable, as long as the swing range of the left/right flap is set to a part of the movable range.

Further, the above embodiments deals with cases where the installation position of the indoor unit is selected by operating the remote controller. The present invention however is not limited to this. For example, the swing range of the left/right flap may be set based on the installation position of the indoor unit which is automatically found out based on a distance between the indoor unit and the wall surface specified by a sensor or the like provided to the indoor unit.

INDUSTRIAL APPLICABILITY

The present invention realizes an air conditioner whose left/right flap is prevented from moving outside a set swing range.

REFERENCE NUMERALS

1 Air Conditioner
1*a* Indoor Unit
14 Outlet Port
16 Left/Right Flap (Wind Direction Changing Flap)
17 Control Unit (Controller)
P1, P41, P42 Reference Position

The invention claimed is:

1. An air conditioner, comprising:

a wind direction changing flap which changes, to the left or right, the direction of the wind from an outlet port of an indoor unit by reciprocating with in a movable range; and a controller which controls a movement of the wind direction changing flap, the controller configured to determine, upon receipt of a command to start movement of the wind direction changing flap, whether a swing range has been set for the wind direction changing flap, the swing range being a subset of the movable range;

move, responsive to a determination that the swing range has been set, the wind direction changing flap to a reference position prior to reciprocating the wind direction changing flap within the set swing range; and allow, responsive to a determination that a swing range has not been set, the wind direction changing flap to reciprocate within the movable range;

wherein, when the wind direction changing flap is to be moved to the reference position, the controller starts movement of the wind direction changing flap so that the wind direction changing flap starts to move in a direction in which the wind direction changing flap has been moving at the end of the previous movement, when an initial moving direction of the wind direction changing flap is a direction away from the reference position, the controller moves the wind direction changing flap to an end of the set swing range opposite to the reference position, and then returns the wind direction changing flap to the reference position, and when the initial moving direction of the wind direction changing flap is a direction towards the reference position, the controller directly returns the wind direction changing flap to the reference position.

2. The air conditioner according to claim 1, wherein the swing range is set based on a distance from the reference position.

3. The air conditioner according to claim 1, wherein the reference position is set at a position corresponding to an end of the movable range.

4. The air conditioner according to claim 1, wherein a right-side reference position and a left-side reference position are provided on both a right side and a left side of the swing range, respectively, and one of the right-side reference position and the left-side reference position closer to the swing range is set as the reference position.

5. The air conditioner according to claim 1, wherein at the start of operation of the indoor unit, the controller returns the wind direction changing flap of the indoor unit to the reference position if the swing range has been set.

6. The air conditioner according to claim 1, wherein the controller returns the wind direction changing flap to the reference position when the swing range is set to a part of the movable range.

7. The air conditioner according to claim 1, wherein the swing range of the wind direction changing flap is set based on an installation position of the indoor unit.

8. The air conditioner according to claim 2, wherein the reference position is set at a position corresponding to an end of the movable range.

9. The air conditioner according to claim 2, wherein a right-side reference position and a left-side reference position are provided on both a right side and a left side of the swing range, respectively, and one of the right-side reference position and the left-side reference position closer to the wind direction changing flap is set as the reference position.

10. The air conditioner according to claim 3, wherein a right-side reference position and a left-side reference position are provided on both a right side and a left side of the swing range, respectively, and one of the right-side reference position and the left-side reference position closer to the wind direction changing flap is set as the reference position.

11. The air conditioner according to claim 8, wherein a right-side reference position and a left-side reference position are provided on both a right side and a left side of the swing range, respectively, and one of the right-side reference position and the left-side reference position closer to the wind direction changing flap is set as the reference position.

12. The air conditioner according to claim 3, wherein at the start of operation of the indoor unit, the controller returns the wind direction changing flap of the indoor unit to the reference position if the swing range has been set.

13. The air conditioner according to claim 4, wherein at the start of operation of the indoor unit, the controller returns the wind direction changing flap of the indoor unit to the reference position if the swing range has been set.

14. The air conditioner according to claim 3, wherein the controller returns the wind direction changing flap to the reference position when the swing range is set to a part of the movable range.

15. The air conditioner according to claim 4, wherein the controller returns the wind direction changing flap to the reference position when the swing range is set to a part of the movable range.

16. The air conditioner according to claim 3, wherein the swing range of the wind direction changing flap is set based on an installation position of the indoor unit.

17. The air conditioner according to claim 4, wherein the swing range of the wind direction changing flap is set based on an installation position of the indoor unit.

* * * * *